US009824558B2

(12) United States Patent
Warren

(10) Patent No.: US 9,824,558 B2
(45) Date of Patent: Nov. 21, 2017

(54) AUTOMATED MOTION DISTURBANCE DETECTION AND ALERTING

(76) Inventor: Nicholas Warren, Palo Alto, CA (US)

( * ) Notice: Subject to any disclaimer, the term of this patent is extended or adjusted under 35 U.S.C. 154(b) by 342 days.

(21) Appl. No.: 12/778,158

(22) Filed: May 12, 2010

(65) Prior Publication Data

US 2011/0279273 A1 Nov. 17, 2011

(51) Int. Cl.

| | |
|---|---|
| ***G08B 13/14*** | (2006.01) |
| *G08B 13/196* | (2006.01) |
| *G08B 25/01* | (2006.01) |

(52) U.S. Cl.

CPC .... *G08B 13/1436* (2013.01); *G08B 13/19697* (2013.01); *G08B 25/016* (2013.01)

(58) Field of Classification Search

CPC ..... G08B 13/1436; G08B 25/016

USPC ..... 116/214

See application file for complete search history.

(56) References Cited

U.S. PATENT DOCUMENTS

| | | | | |
|---|---|---|---|---|
| 4,241,850 | A * | 12/1980 | Speer et al. | 222/39 |
| 5,963,131 | A * | 10/1999 | D'Angelo et al. | 340/568.1 |
| 7,644,290 | B2 * | 1/2010 | Ransom et al. | 713/194 |
| 7,801,506 | B2 * | 9/2010 | Haave et al. | 455/404.2 |

* cited by examiner

*Primary Examiner* — Omeed Alizada

(74) *Attorney, Agent, or Firm* — Stephen M. De Klerk

(57) ABSTRACT

Several methods and a system of automated motion disturbance detection and alerting are disclosed. In one embodiment, a method includes associating a protection device with a movable tangible personal property. The method also includes activating the protection device remotely. The method further includes detecting, through a sensor in the protection device, a motion disturbance of the movable tangible personal property. The method further includes automatically responding based on a set of user-specified preferences when an intensity of the motion disturbance exceeds a minimum threshold of a sensitivity associated with the protection device. The method furthermore includes relaying a confirmed motion disturbance of the movable tangible persona property to a user of the protection device. The method furthermore includes protecting the movable tangible personal property through the automatic response of the protection device. The protection device includes a sensor to detect a motion disturbance associated with a movable tangible personal property.

38 Claims, 5 Drawing Sheets

AUTOMATED MOTION DISTURBANCE DETECTION AND ALERTING

FIELD OF TECHNOLOGY

This disclosure relates generally to the technical field of device protection and safety, in one embodiment to a method, a system and a protection device to automatically detect motion disturbance and provide automatic alerts.

BACKGROUND

An owner of a movable tangible personal property (e.g., a laptop, a wallet, a purse, valuable item, and the like) may want to protect the movable tangible personal property from theft and/or tampering by a third party. The owner may also want to deter the third party from stealing and/or tampering with the movable tangible personal property. The owner may want to monitor a state of the movable tangible personal property from a remote location when the owner is unable to be physically present to protect the movable tangible personal property. The owner may be able to prevent the theft and/or tampering of the movable tangible personal property if the owner is notified of a disturbance of the movable tangible personal property. If the movable tangible personal property has been stolen and/or tampered with, the owner may want to track the movable tangible personal property to reclaim it. The owner may also have a strong incentive to gather proof associated with a set of circumstances associated with the theft and/or tampering of the movable tangible personal property and/or may want to identify an alleged intruder of the movable tangible personal property.

For example, the owner may have a set of valuable and/or confidential information stored in the owner's laptop. The theft of the laptop may expose the owner to immense financial and legal liability as a result of lost information stored in the laptop. In addition to losing a set of valuable personal and private information from the laptop, the owner may also create legal and financial liability for an employer of the owner if the laptop housed a set of confidential information associated with the employer. The owner and/or employer may incur heavy financial losses as a result and may permanently suffer from diminished reputation indirectly caused by an unauthorized dissemination of confidential information.

SUMMARY

Several methods and a system of automatic motion disturbance detection and alerting are disclosed. In one aspect, a method includes associating a protection device with a movable tangible personal property. The method also includes activating the protection device remotely. The method further includes detecting, through a sensor in the protection device, a motion disturbance of the movable tangible personal property. The method further includes automatically responding based on a set of user-specified preferences when an intensity of the motion disturbance exceeds a minimum threshold of a sensitivity associated with the protection device. The method further includes relaying a confirmed motion disturbance of the movable tangible persona property to a user of the protection device. The method further includes protecting the movable tangible personal property through the automatic response of the protection device.

The method may include associating the protection device to a host data processing system through at least one of a wired interface and a wireless interface. The method may include accessing a network through the host data process system. The method may also include determining a unique identifier information for a given protection device. The method may further include associating a designated user-account with the unique identifier information. The method may further include storing a metadata associated with the given protection device in the designated user-account. The method may further include automatically updating a set of real-time information associated with the given protection device to the designated user-account.

The method may further include generating an automatic indicator on a user interface associated with the designated user-account when the sensor detects the confirmed motion disturbance. Furthermore, the method may include activating the protection device remotely through a gesture on at least one of a mobile device, a smart phone device, an input device of a data processing system, an output device of a data processing system, an infrared remote, a custom-designed remote configured for a particular protection device, a website synched with the designated user-account associated with the particular protection device and an RFID tag configured to the particular protection device.

The method may also include deactivating the protection device remotely through a gesture on at least one of a mobile device, a smart phone device, an input device of a data processing system, an output device of a data processing system, an infrared remote, a custom-designed remote configured for a particular protection device, a website synched with the designated user-account associated with the particular protection device and an RFID tag configured to the particular protection device.

The input device of a data processing may be one or more of a touch screen display of a user interface, a keyboard, a mouse and a sensor synched with the data processing system. The output device of a data processing system may be at least one of a monitor display of the user interface and the touch screen display of the user interface. Further, the method may also include permitting the user to specify the set of user-specified preferences associated with the protection device in the designated user-account. Furthermore, the method may include accessing the designated user-account through a device having a capability of accessing the internet.

The method may also include automatically generating the indicator to a user interface of the device having the capability of accessing the internet when a confirmed motion disturbance is detected. The method may further include managing the designated user-account through the device having the capability of accessing the internet. The method may furthermore include activating the protection device through the device having the capability to access the internet. The method may furthermore include deactivating the protection device through the device having the capability of accessing the internet.

Furthermore, the method may include linking the protection device to the movable tangible personal method through at least one of a physical proximity to the movable tangible personal property, a tethering to the movable tangible personal property, a predefined geospatial distance to the movable tangible personal property, a magnetic attachment to a part of the movable tangible personal property and a physical attachment to a part of the movable tangible personal property.

Furthermore, the method may include associating a preferred sensor with the unique identifier information. The method may also include configuring the protection device with the preferred sensor. Furthermore, the method may include signaling, through an array of flashing LED lights, an active state of the protection device. The method may also include configuring the array of flashing LED lights through the set of preferences associated with the designated user-account for the protection device. The method may also include charging the protection device through an electrical outlet associated with the movable tangible personal property. The method may further include automatically switching to a battery power stored inside the protection device when the electrical outlet is unavailable.

Furthermore, when the movable tangible personal property is a particular data processing system, the method may include synchronizing a set of predefined capabilities of the particular data processing system with the protection device. The method may also include automatically responding to the confirmed motion disturbance through the particular data processing system by exhibiting at least one capability of the set of predefined capabilities of the particular data processing system. The set of predefined capabilities of the particular data processing system may be a photographic capability, a video recording capability, an audio recording capability, a music playing capability and a GPS capability.

In another aspect, a protection device includes a sensor to detect a motion disturbance associated with a movable tangible personal property. The protection device also includes a circuitry coupled with the sensor to communicate through at least one of a wired interface and a wireless interface, the motion disturbance to a host data processing system. The protection device further includes a siren to be activated when an intensity of the motion disturbance exceeds a minimum threshold of a sensitivity associated with the protection device. The protection device may include a set of flashing LED lights to be activated when the intensity of the motion disturbance exceeds a minimum threshold of a sensitivity associated with the protection device. The protection device may also include an audio recorder to commence recording when the intensity of the motion disturbance exceeds a minimum threshold of a sensitivity associated with the protection device.

The protection device may further include a camera component to capture photographs of a surrounding environment when the intensity of the motion disturbance exceeds a minimum threshold of a sensitivity associated with the protection device. The protection device may further include a video recorder to commence recording when the intensity of the motion disturbance exceeds a minimum threshold of a sensitivity associated with the protection device. The protection device may further include a GPS tracker component to be activated when the intensity of the motion disturbance exceeds a minimum threshold of a sensitivity associated with the protection device. The protection device may further include an odor emanating component to emanate an odor when the intensity of the motion disturbance exceeds a minimum threshold of a sensitivity associated with the protection device.

In yet another aspect, a system includes a protection device to detect a motion disturbance of a movable tangible personal property. The system also includes a host data processing system to receive, through at least one of a wired interface and a wireless interface, a set of information associated with the motion disturbance of the movable tangible personal property. The system further includes a tracking component in the host data processing system to monitor the set of information associated with the motion disturbance of the movable tangible personal property. The system furthermore includes a link to a network having a set of user-specified preferences associated with a sensitivity of the protection device. The system furthermore includes a circuitry in the host data processing system to automatically communicate to the protection device when an intensity of the motion disturbance exceeds a minimum threshold of a sensitivity associated with the protection device.

In addition the system may include a designated user-account to store a set of metadata associated with the protection device and the set of user-specified preferences associated with a sensitivity of the protection device. The system may also include a set of devices configured with the host data processing system to receive an indicator when a sensor in the protection device detects a confirmed motion disturbance and to activate and deactivate the protection device remotely.

Other aspects will be apparent from the following description and the appended claims.

BRIEF DESCRIPTION OF THE VIEWS OF DRAWINGS

Example embodiments are illustrated by way of example and not limitation in the figures of accompanying drawings, in which like references indicate similar elements and in which.

Other features of the present embodiments will be apparent from accompanying Drawings and from the Detailed Description that follows.

DETAILED DESCRIPTION

Example embodiments, as described below, may be used to automatically detect motion disturbance and provide automatic alerts.

It will be appreciated that the various embodiments discussed herein need not necessarily belong to the same group of exemplary embodiments, and may be grouped into various other embodiments not explicitly disclosed herein. In the following description, for purposes of explanation, numerous specific details are set forth in order to provide a thorough understanding of the various embodiments. Although the present embodiments have been described with reference to specific example embodiments, it will be evident that various modifications and changes may be made to these embodiments without departing from the broader spirit and scope of the various embodiments.

Figure 1A:
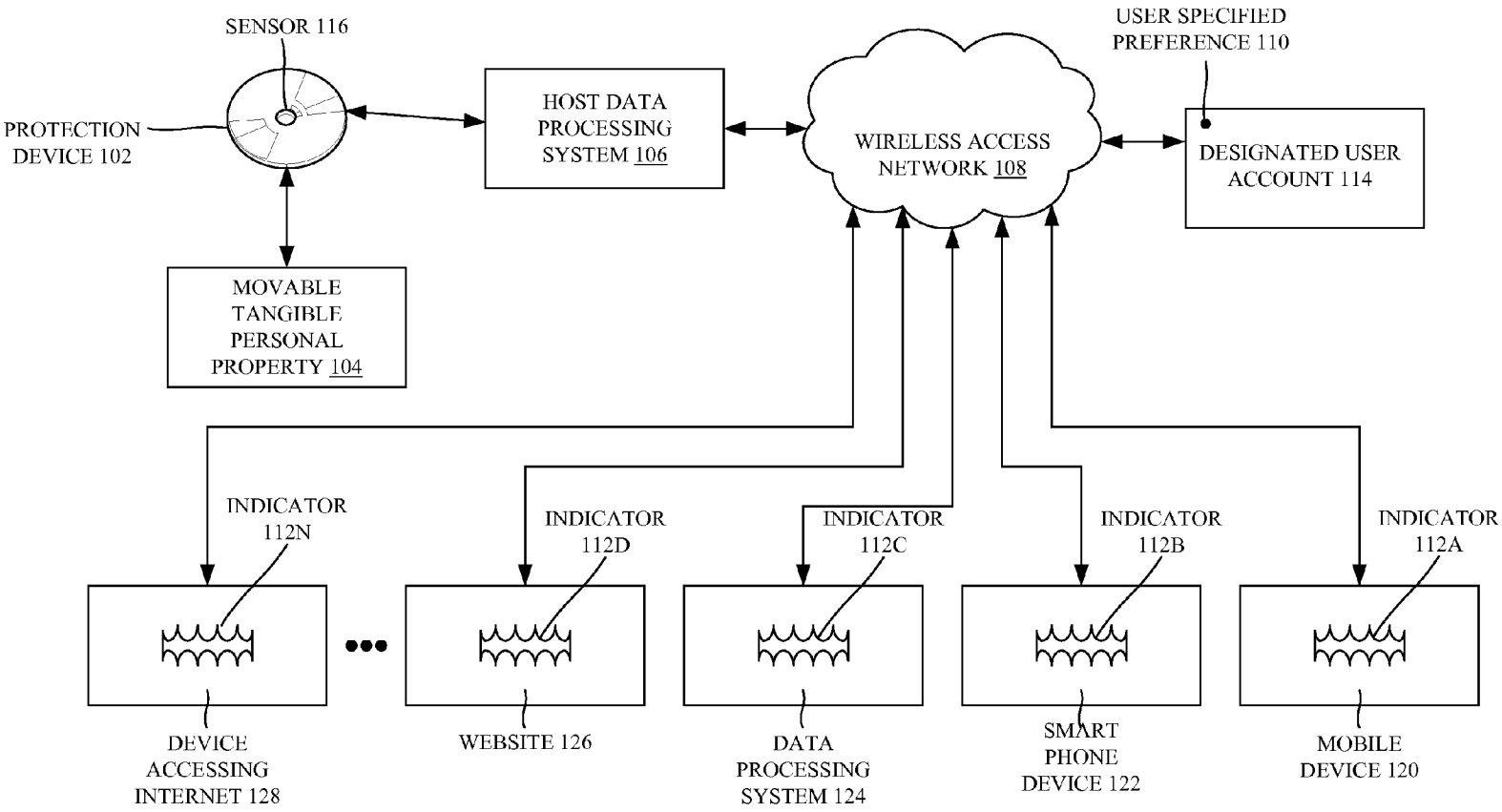
FIGS. 1A-1B is a system view illustrating an interaction flow in a system, according to one or more embodiments.
Figure 1B:
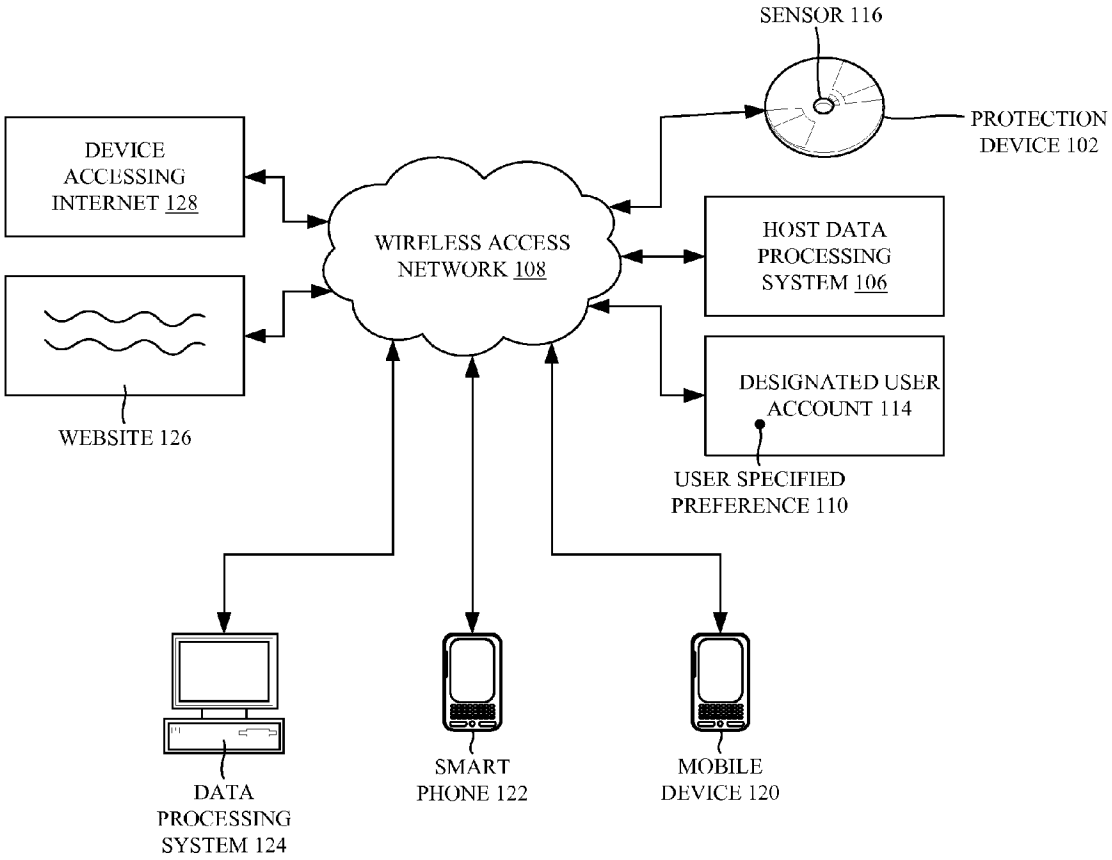

FIGS. 1A-1B is a system view illustrating an interaction flow, according to one or more embodiments. In one or more embodiments of the method disclosed herein, a protection device 102 may be configured to automatically detect a motion disturbance of a movable tangible personal property 104 and automatically alert a system and/or a user. As used herein the term "motion disturbance" may refer to a predefined degree of displacement from a given position. The protection device 102 may be operatively coupled to the movable tangible personal property 104. In one or more embodiments, the protection device may be wirelessly coupled to the movable tangible personal property. Examples of the movable tangible, personal property may include, but is not limited to, a laptop, a mobile phone, a wallet, a book, a portable electronic device, a multimedia player, a vehicle, a watch, and the like.

In one or more embodiments, the protection device 102 may be coupled to a host data processing system 106 (e.g., a remote server or a local server) through a wired interface and/or a wireless interface. A network (e.g., a wireless network 108, or a wired network, and the like) may be accessed through the host data processing system. In one or more embodiments, the data processing system may be an internal processing component of the movable tangible personal property 102. In one or more embodiments, the protection device 102 may be linked to the movable tangible personal property through a physical proximity to the movable tangible personal property 104, a tethering to the movable tangible personal property 104, a predefined geospatial distance to the movable tangible personal property 104, a magnetic attachment to a part of the movable tangible personal property 104 and/or a physical attachment to a part of the movable tangible personal property 104. In one or more preferred embodiments, the physical proximity to the movable tangible personal property 104 may be for example, no more than a radius of three meters from the protection device 102.

The protection device 102 may be activated. The activation may be an automatic activation (e.g., the protection device 102 may get automatically activated on being associated with the movable tangible personal property) or manual activation by the user of the movable tangible personal property. Unique identifier information may be determined for the protection device 102 on activation. In one or more embodiments, a preferred sensor may be associated with the unique identifier information. The protection device 102 may be configured with the preferred sensor. Examples of the preferred sensor may include but is not limited to an accelerometer sensor, a tilt sensor, a gyroscopic sensor, an infrared sensor, a laser sensor, a camera sensor, an ultrasonic distance sensor and the like. In addition, a designated user account 114 may be associated with the unique identifier information. The designated user account 114 may be accessible from a server through a network. The designated user account 114 may also be accessible from a wired or wireless interface through the protection device 102. A metadata (e.g., volume of sound alert of a sensor associated with the protection device 102) associated with the given protection device 102 may be stored in the designated user account 114. The user may be permitted to specify a set of user-specified preferences 110 associated with the protection device 102 in the designated user account 114.

Examples of the user-specified preferences 110 may include but are not limited to, a threshold of motion disturbance, a preferred mode of alert (e.g., via email, or via message), volume of a siren, and the like. In one or more embodiments, the designated user account 114 may be accessed through a device having a capability of accessing the internet 128. The device having the capability of accessing the internet 128 may be one or more of the mobile device 120, the smart phone device 122, the data processing system 124, a music device, and the like. In one or more embodiments, an indicator may be automatically generated to a user interface of the device having the capability of accessing the internet 128 when a confirmed motion disturbance is detected. The indicators may include, for example, indicator 112 *a*, indicator 112*b*, indicator 112*c*, indicator 112*d*, of the mobile device 120, the smart phone device 122, the data processing system 124, and the website 126 respectively as illustrated in FIGS. 1A-1B. The protection device 102 may be activated/or deactivated through the device having the capability of accessing the internet 128.

The activation may be a remote activation and/or a local activation. In one or more embodiments, the protection device 102 may be activated and/or deactivated remotely through a gesture on one or more of the mobile device 120, the smart phone device 122, an input device of the data processing system 124, an output device of the data processing system 124, an infrared remote, a custom-designed remote configured for a particular protection device 102, a website 126 synched with the designated user-account 114 associated with the particular protection device 102, a radio frequency identification (RFID) tag configured to the particular protection device 102, and any device accessing the internet 128. Examples of the input device of the data processing system may include, but are not limited to one or more of a touch screen display of a user interface (e.g., a graphical user interface), a keyboard, a mouse, a sensor synched with the data processing system, and the like. Also, examples of the output device of the data processing system may include, but are not limited to one or more of a monitor display of the user interface, the touch screen display of the user interface, and the like.

Figure 2:
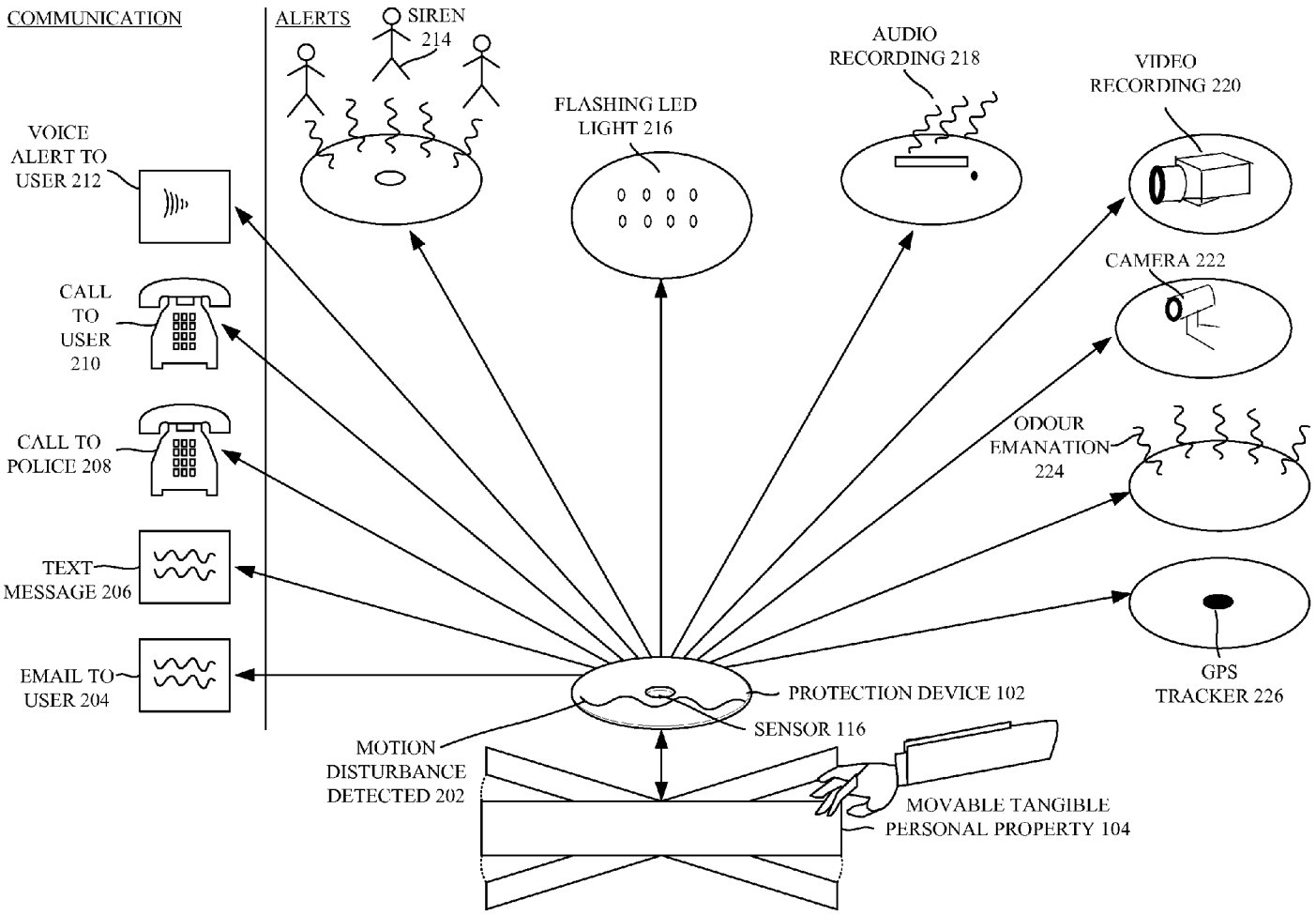
FIG. 2 illustrates automatic motion disturbance detection and alerting, according to one or more embodiments.

FIG. 2 illustrates automatic motion disturbance detection and alerting in accordance with one or more embodiments. In one or more embodiments, a motion disturbance 202 of the movable tangible personal property 104 may be detected, through a sensor 116 in the protection device 102. In one or more embodiments, when an intensity of the motion disturbance 202 exceeds a minimum threshold of a sensitivity associated with the protection device 102, an automatic response may be provided based on the set of user-specified preferences. For example, if a laptop constituting a movable tangible personal property is displaced to a certain distance away (minimum threshold of the sensitivity of the protection device) from an initial position, the protection device associated with the laptop may automatically generate and transmit a message alert (user-specified preference) to a mobile phone of the user.

Further, in one or more embodiments, a set of real-time information associated with the given protection device 102 may be automatically updated to the designated user account 114. In one or more embodiments, an automatic indicator may be generated on a user interface associated with the designated user account 114 when the sensor 116 detects the confirmed motion disturbance. In one or more embodiments a confirmed motion disturbance 202 of the movable tangible personal property may be relayed to a user of the protection device 102. In one or more embodiments, an indicator may be automatically generated on a user interface of the device having the capability of accessing the internet when a confirmed motion disturbance 202 is detected. The designated user account 114 may be managed through the device having the capability of accessing the internet 128.

The set of preferences associated with the designated user account 114 may include but are not limited to one or more of a preferred indicator, a preferred sensitivity of the protection device 102, a preferred response of the protection device 102, a preferred response time of the protection device 102, a preferred voice alert, a user-recorded voice alert, a preferred alarm, a choice of the protection device 102, a preferred alert on the host interface, a preferred alert on a set of devices associated with the designated user account 114 through a wireless capability, a preferred alert on a user-specified communication channel, a preferred volume of an alarm on the protection device 102, a preferred speed of the alarm on the protection device 102, a preferred siren on the protection device 102, a set of options associated with a flashing LED light capability on the protection device 102, a set of options associated with an audio recording capability on the protection device 102, a set of options associated with a photographic capability on the protection device 102, a set of options associated with a video recording capability on the protection device 102, a set of options associated with a odor emanating capability of the protection device 102 and a set of options associated with a GPS tracking capability of the protection device 102.

Examples of the preferred indicator may include but are not limited to one or more of an electronic mail(email) 204 to the personal account of the user, a text message 206 on a cellular phone, an email accessible through a smart phone, a text message accessible through a smart phone, a voice alert 212 on a cellular phone, a voice alert 212 on the smart phone, a telephone call to the cellular phone, a telephone call to a law enforcement agency (e.g., a call to police 208), a telephone call 210 to an individual associated with a current geospatial location of the protection device 102, and the like. The preferred sensitivity of the protection device 102 may include but is not limited to one or more of a time period of sensitivity of the sensor 116 in the protection device 102, a geographical radius of sensitivity around the sensor 116 in the protection device 102, a fault tolerance associated with the sensitivity of the sensor 116 in the protection device 102 and a level of sensitivity of the sensor 116 in the protection device 102.

Examples of the preferred response of the protection device 102 may include but is not limited to one or more of a communication through the preferred indicator (e.g., an email, a message), an audible siren 214 emitted through the protection device 102, an audible voice alert 212 emitted through the protection device 102, a flashing LED light 216 emitted through the protection device 102, a photographic shot of an environment executed through the protection device 102, an audio recording 218 executed through the protection device 102, a video recording 220 executed through the protection device 102, an odor emanation 224 through the protection device 102 and an activation of a GPS tracker 226 linked to the protection device 102. The set of options associated with a flashing LED light capability may be one or more of an intensity of the LED lights, a frequency of flashing of the LED lights, a color of the LED lights and a pattern of the LED lights. The set of options associated with the audio recording capability of the protection device 102 may be one or more of a recording time, a recording frequency, a recording pattern and an automatic transmission of a recorded audio byte to the user.

The set of options associated with the photographic capability of the protection device 102 may be one or more of camera angle of the protection device 102, a frequency of photographic captures and an automatic transmission of the photograph to the user. The set of options associated with the video recording capability of the protection device 102 may be one or more of a camera angle of the video recorder, a recording time, a frequency of video recording, a video recording pattern and an automatic transmission of the video file to the user. Also, the set of options associated with the odor emanating capability of the protection device may be one or more of a type of odor to be emanated, an emanation frequency, an emanation pattern and an emanation intensity. Further, the set of options associated with the GPS tracking capability of the protection device 102 may be one or more of an automatic transmission of a set of data associated with the current geospatial location of the protection device 102 and a frequency of updates associated with the GPS tracker.

In one or more embodiments, the movable tangible personal property 104 may be protected through the automatic response of the protection device 102. In one or more embodiments, an active state of the protection device 102 may be signaled, through an array of flashing LED lights 216. The array of flashing LED lights 216 may be configured through the set of preferences associated with the designated user account 114 for the protection device 102. In one or more embodiments, the protection device 102 may be charged, through an electrical outlet associated with the movable tangible personal property 104. A battery power stored inside the protection device 102 may be automatically switched when the electrical outlet is unavailable.

The protection device 102 disclosed herein may include a sensor 116 to detect a motion disturbance associated with a movable tangible personal property 104. The protection device 102 may also include a circuitry coupled with the sensor 116 to communicate through at least one of a wired interface and a wireless interface, the motion disturbance to a host data processing system 106. In one or more embodiments, the protection device 102 may also include a siren to be activated when an intensity of the motion disturbance exceeds a minimum threshold of a sensitivity associated with the protection device 102. In one or more embodiments, the protection device 102 may also include a set of flashing LED lights to be activated when the intensity of the motion disturbance exceeds a minimum threshold of a sensitivity associated with the protection device 102.

In one or more embodiments, the protection device 102 may also include an audio recorder to commence recording when the intensity of the motion disturbance exceeds a minimum threshold of a sensitivity associated with the protection device 102. Furthermore, in one or more embodiments, a camera component may be coupled to the protection device 102 to capture photographs of a surrounding environment when the intensity of the motion disturbance exceeds a minimum threshold of a sensitivity associated with the protection device 102. In one or more embodiments, the protection device 102 may also include a video recorder to commence recording when the intensity of the motion disturbance exceeds a minimum threshold of a sensitivity associated with the protection device 102. In one or more embodiments, the protection device 102 may also include a GPS tracker component to be activated when the intensity of the motion disturbance exceeds a minimum threshold of a sensitivity associated with the protection device 102. In one or more embodiments, the protection device 102 may also include an odor emanating component to emanate an odor when the intensity of the motion disturbance exceeds a minimum threshold of a sensitivity associated with the protection device 102.

The system disclosed herein may include a protection device 102 to detect a motion disturbance of a movable tangible personal property 104. The system may also include a host data processing system 106. The host data processing system may be configured to receive, through one or more of a wired interface and a wireless interface, a set of information associated with the motion disturbance of the movable tangible personal property 104. The system may further include a tracking component in the host data processing system 106 configured to monitor the set of information associated with the motion disturbance of the movable tangible personal property 104. In addition the system may include a link to a network having a set of user-specified preferences 110 associated with a sensitivity of the protection device 102. The system may further include a circuitry in the host data processing system 106 to automatically communicate to the protection device 102 when an intensity of the motion disturbance exceeds a minimum threshold of a sensitivity associated with the protection device 102.

In one or more embodiments, the system may further include a designated user account 114 to store a set of metadata associated with the protection device 102 and the set of user-specified preferences 110 associated with a sensitivity of the protection device 102. In one or more embodiments, the system may further include a set of devices configured with the host data processing system 106 to receive an indicator when a sensor 116 in the protection device 102 detects a confirmed motion disturbance and to activate and deactivate the protection device 102 remotely. The set of devices configured with the host data processing system 106 to receive the indicator may include one or more of a mobile device, a smart phone device, an input device of a data processing system, an output device of a data processing system, an infrared remote, a custom-designed remote configured for a particular protection device 102, a website synched with the designated user-account associated with the particular protection device 102 and an RFID tag configured to the particular protection device 102.

Figure 3A:
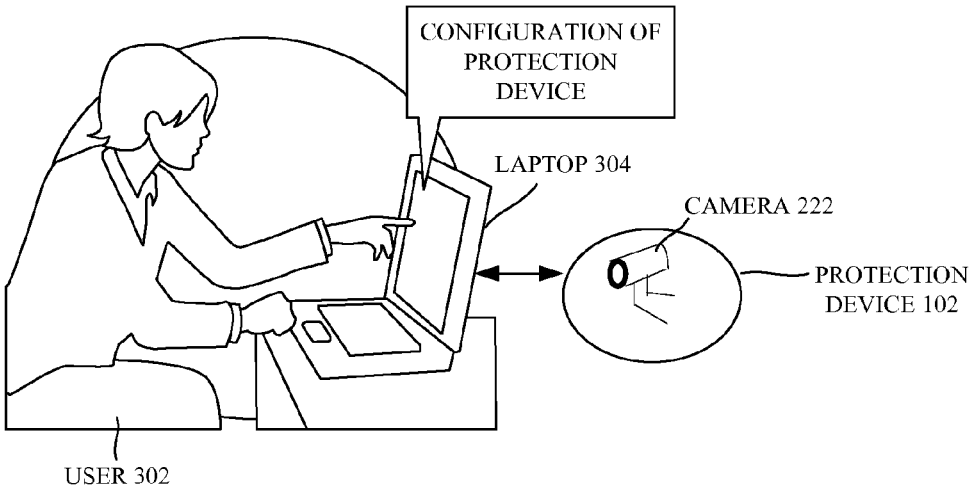
FIGS. 3A-3D is an interaction flow illustrating an example scenario of automatic motion disturbance detection and alerting, according to one or more embodiments.
Figure 3B:
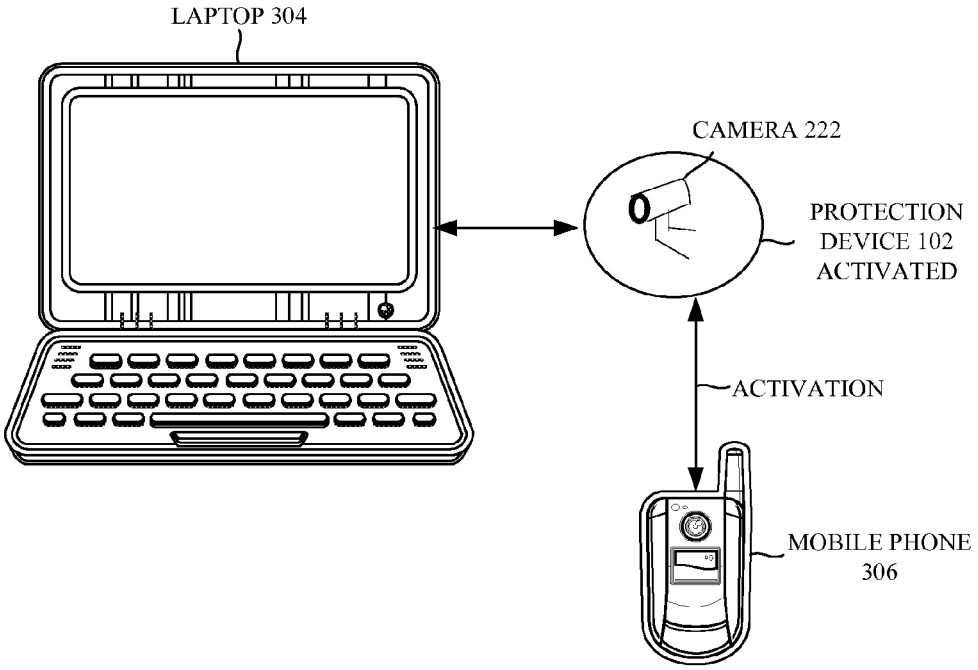

FIGS. 3A-3D is an interaction flow illustrating an example scenario of automatic motion disturbance detection and alerting, according to one or more embodiments. As illustrated in FIG. 3A, a user 302 configures a protection device 102 to protect a movable tangible personal property (e.g. laptop 304). The configuration may include data associated with the user 302, that the protection device 102 may use to authenticate the user 302 (e.g., data associated with the facial features of the user 302), one or more thresholds (e.g., extent of displacement of the laptop 304 from a given position) for activating an alerting mechanism (e.g., siren) of the protection device 102, mode of alerting the user 302, and the like. During configuring the protection device 102, the user 304 operatively couples the protection device 102 with the laptop 304 wirelessly. Once the protection device 102 is configured and coupled to the laptop 304, the protection device is activated through a mobile phone 306 as illustrated in FIG. 3B to protect the laptop 304 in the absence of the user 302.

Figure 3C:
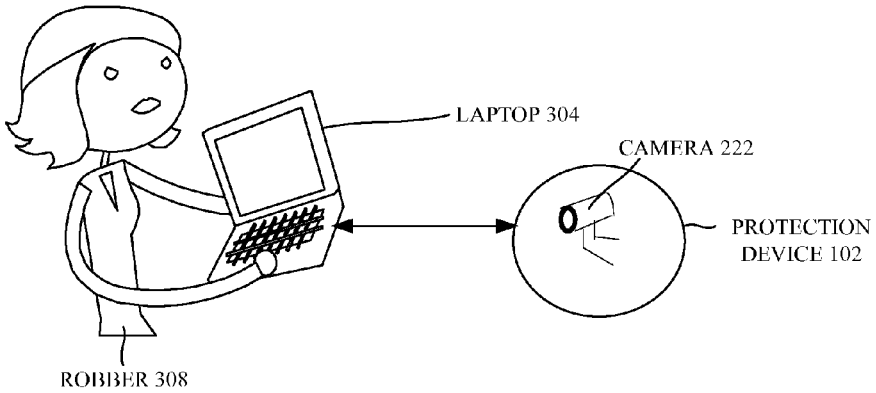
Figure 3D:
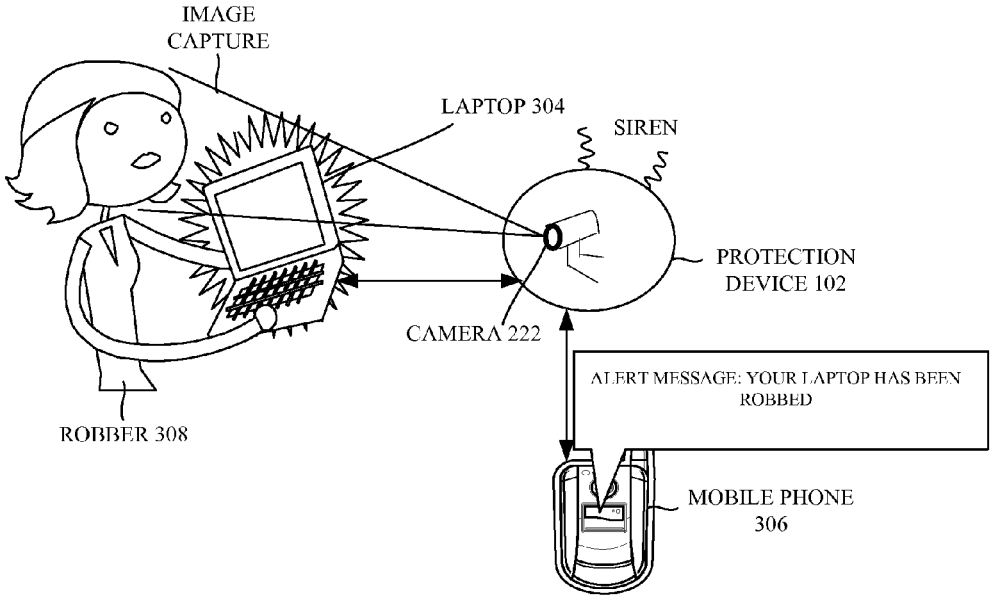

The activated protection device 102 monitors the laptop 304 continuously based on the configuration. In the absence of the user 302, if a robber 308 tries to displace the laptop 304 from a current position as illustrated in FIG. 3C, the activated protection device 102 automatically detects a motion disturbance and captures an image of the robber 308. A host data processing system (e.g., a remote server) coupled to the protection device matches a data associated with the captured image with the data associated with the facial features of the user 302 in a designated user-account and determines dissimilarity. The host data processing system then actuates an alert mechanism within the protection device 102 and the protection device 102 gives out a siren to alert the user 304 as illustrated in FIG. 3D.

Although the present embodiments have been described with reference to specific example embodiments, it will be evident that various modifications and changes may be made to these embodiments without departing from the broader spirit and scope of the various embodiments. Accordingly, the specification and drawings are to be regarded in an illustrative rather than a restrictive sense.

What is claimed is:

1. A method comprising:

physically attaching a protection device to a movable tangible personal property;

creating a set of user-specified preferences for the protection device, the user-specified preferences including a minimum threshold of sensitivity;

storing metadata in a designated user account on a host data processing system, the metadata including the user-specified preferences that includes the minimum threshold of sensitivity, wherein the protection device and the host processing system are remote from one another and the protection device moves with the movable tangible property without the host processing system;

detecting, through a sensor in the protection device, a motion disturbance of the movable tangible personal property when the sensor is displaced;

determining, with a data processing component, a confirmed disturbance of the movable tangible property based on the set of user-specified preferences when an intensity of the motion disturbance by which the sensor is displaced exceeds the minimum threshold of sensitivity associated with the protection device; and creating, in response to the confirmed motion disturbance of the movable tangible personal property a message alert to a user.

2. The method of claim 1 further comprising:

associating the protection device to the host data processing system through at least one of a wired interface and a wireless interface; and accessing a network through the host data process system.

3. The method of claim 2 further comprising:

determining a unique identifier for a given protection device;

associating a designated user-account with the unique identifier information; and storing a metadata associated with the given protection device in the designated user-account.

4. The method of claim 3 further comprising:

automatically updating a set of real-time information associated with the given protection device to the designated user-account; and generating an automatic indicator on a user interface associated with the designated user-account when the sensor detects the confirmed motion disturbance.

5. The method of claim 4 further comprising:

activating the protection device remotely through a gesture on at least one of a mobile device, a smart phone device, an input device of a data processing system, an output device of a data processing system, an infrared remote, a custom-designed remote configured for a particular protection device, a website synched with the designated user-account associated with the particular protection device and an RFID tag configured to the particular protection device; and deactivating the protection device remotely through a gesture on at least one of a mobile device, a smart phone device, an input device of a data processing system, an output device of a data processing system, an infrared remote, a custom-designed remote configured for the particular protection device, a website synced with the designated user-account associated with the particular protection device and an RFID tag configured to the particular protection device.

6. The method of claim 5 wherein the input device of a data processing is at least one of a touch screen display of a user interface, a keyboard, a mouse and a sensor synched with the data processing system.

7. The method of claim 6 wherein the output device of a data processing system is at least one of a monitor display of the user interface and the touch screen display of the user interface.

8. The method of claim 1, wherein the set of user-specified preferences associated with the protection device includes a geographical radius of sensitivity around the sensor in the protection device.

9. The method of claim 1 wherein the set of preferences associated with the designated user-account is at least one of a preferred indicator, a preferred sensitivity of the protection device, a preferred response of the protection device, a preferred response time of the protection device, a preferred voice alert, a user-recorded voice alert, a preferred alarm choice of the protection device, a preferred alert on the host interface, a preferred alert on a set of devices associated with the designated user-account through a wireless capability, a preferred alert on a user-specified communication channel, a preferred volume of an alarm on the protection device, a preferred speed of the alarm on the protection device, a preferred siren on the protection device, a set of options associated with a flashing LED light capability on the protection device, a set of options associated with an audio recording capability on the protection device, a set of options associated with a photographic capability on the protection device, a set of options associated with a video recording capability on the protection device, a set of options associated with an odor emanating capability of the protection device and a set of options associated with a GPS tracking capability of the protection device.

10. The method of claim 9 wherein the preferred indicator is at least one of an email to the personal account of the user, a text message on a cellular phone, an email accessible through a smart phone, a text message accessible through a smart phone, a voice alert on a cellular phone, a voice alert on the smart phone, a telephone call to the cellular phone, a telephone call to a law enforcement agency and a telephone call to an individual associated with a current geospatial location of the protection device.

11. The method of claim 10 wherein the preferred response of the protection device is at least one of a communication through the preferred indicator, an audible siren emitted through the protection device, an audible voice alert emitted through the protection device, a flashing LED light emitted through the protection device, a photograph of an environment executed through the protection device, an audio recording executed through the protection device, a video recording executed through the protection device, an odor emanated through the protection device and an activation of a GPS tracker linked to the protection device.

12. The method of claim 11 wherein the set of options associated with a flashing LED light capability is at least one of an intensity of the LED lights, a frequency of flashing of the LED lights, a color of the LED lights and a pattern of the LED lights.

13. The method of claim 12 wherein the set of options associated with the audio recording capability of the protection device is at least one of a recording time, a recording frequency, a recording pattern and an automatic transmission of a recorded audio byte to the user.

14. The method of claim 13 wherein the set of options associated with the photographic capability of the protection device is at least one of camera angle of the protection device, a frequency of photographic captures and an automatic transmission of the photograph to the user.

15. The method of claim 14 wherein the set of options associated with the video recording capability of the protection device is at least one of a camera angle of the video recorder, a recording time, a frequency of video recording, a video recording pattern and an automatic transmission of the video file to the user.

16. The method of claim 15 wherein the set of options associated with the odor emanating capability of the protection device is at least one of a type of odor to be emanated, an emanation frequency, an emanation pattern and an emanation intensity.

17. The method of claim 16 wherein the set of options associated with the GPS tracking capability of the protection device is at least one of an automatic transmission of a set of data associated with the current geospatial location of the protection device and a frequency of updates associated with the GPS tracker.

18. The method of claim 17 further comprising:

accessing the designated user-account through a device having a capability of accessing the network;

automatically generating the indicator to a user interface of the device having the capability of accessing the network when a confirmed motion disturbance is detected;

managing the designated user-account through the device having the capability of accessing the network;

activating the protection device through the device having the capability of accessing the network; and deactivating the protection device through the device having the capability of accessing the network.

19. The method of claim 18 wherein the device having the capability of accessing the network is at least one of a remote data processing system, a smartphone, a hand held personal digital assistant (PDA) device, a mobile device and a music device.

20. The method of claim 19 further comprising:

linking the protection device to the movable tangible personal method through at least one of a physical proximity to the movable tangible personal property, a tethering to the movable tangible personal property, a predefined geospatial distance to the movable tangible personal property, a magnetic attachment to a part of the movable tangible personal property and a physical attachment to a part of the movable tangible personal property.

21. The method of claim 19, wherein a physical proximity to the movable tangible personal property is no more than a radius of three meters from the protection device.

22. The method of claim 20 further comprising:

associating a preferred sensor with the unique identifier information; and configuring the protection device with the preferred sensor.

23. The method of claim 22 wherein the preferred sensor is at least one of an accelerometer sensor, a tilt sensor, a gyroscopic sensor, an infrared sensor, a laser sensor, a camera sensor, and an ultrasonic distance sensor.

24. The method of claim 23 further comprising:

signaling, through an array of flashing LED lights, an active state of the protection device; and configuring the array of flashing LED lights through the set of preferences associated with the designated user-account for the protection device.

25. The method of claim 24 further comprising;

charging the protection device through an electrical outlet associated with the movable tangible personal property; and automatically switching to a battery power stored inside the protection device.

26. The method of claim 25 further comprising:

when the movable tangible personal property is a particular data processing system, synchronizing a set of predefined capabilities of the particular data processing system with the protection device; and automatically responding to the confirmed motion disturbance, through the particular data processing system, by exhibiting at least one capability of the set of predefined capabilities of the particular data processing system.

27. The method of claim 26 wherein the set of predefined capabilities of the particular data processing system is at least one of a photographic capability, a video recording capability, an audio recording capability, a music playing capability and a GPS capability.

28. An automated motion detection and alerting system comprising:

a protection device that is physically attachable to a movable tangible personal property;

a host data processing system;

a designated user account on the host data processing system;

a metadata stored in the designated user account on the host data processing system, the metadata including the user-specified preferences that includes the minimum threshold of sensitivity, wherein the protection device and the host processing system are remote from one another and the protection device moves with the movable tangible property without the host processing system;

a sensor in the protection device for detecting a disturbance of the movable tangible personal property when the sensor is displaced;

a data processing component determining a confirmed disturbance of the movable tangible property based on a set of user-specified preferences when an intensity of the motion disturbance by which the sensor is displaced exceeds the minimum threshold of sensitivity associated with the protection device; and a transmitter for transmitting, in response to the confirmed motion disturbance of the movable tangible personal property a message alert to a user.

29. The system of claim 28 further comprising: a set of flashing LED lights to be activated when the intensity of the motion disturbance exceeds a minimum threshold of a sensitivity associated with the protection device.

30. The system of claim 29 further comprising:

an audio recorder to commence recording when the intensity of the motion disturbance exceeds a minimum threshold of sensitivity associated with the protection device.

31. The system of claim 30 further comprising:

a camera component to capture photographs of a surrounding environment when the intensity of the motion disturbance exceeds a minimum threshold of a sensitivity associated with the protection device.

32. The system of claim 31 further comprising:

a video recorder to commence recording when the intensity of the motion disturbance exceeds a minimum threshold of a sensitivity associated with the protection device.

33. The system of claim 32 further comprising:

a GPS tracker component to be activated when the intensity of the motion disturbance exceeds a minimum threshold of a sensitivity associated with the protection device.

34. The system of claim 33 further comprising:

an odor emanating component to emanate an odor when the intensity of the motion disturbance exceeds a minimum threshold of a sensitivity associated with the protection device.

35. The system of claim 28 further comprising:

a host data processing system to receive, through at least one of a wired interface and a wireless interface, a set of information associated with the motion disturbance of the movable tangible personal property; and a tracking component in the host data processing system to monitor the set of information associated with the motion disturbance of the movable tangible personal property;

a link to a network having a set of user-specified preferences associated with a sensitivity of the protection device by which the sensor is displaced as measured from the first position to the second position, wherein the sensitivity of the protection device is a geographical radius of sensitivity around the sensor in the protection device; and a circuitry in the host data processing system to automatically communicate to the protection device when an intensity of the motion disturbance exceeds a minimum threshold of the sensitivity associated with the protection device.

36. The system of claim 35 further comprising:

a designated user-account to store a set of metadata associated with the protection device and the set of user-specified preferences associated with the sensitivity of the protection device.

37. The system of claim 36 further comprising:

a set of devices configured with the host data processing system to receive an indicator when a sensor in the protection device detects a confirmed motion disturbance and to activate and deactivate the protection device remotely.

38. The system of claim 37 wherein the set of devices configured with the host data processing system to receive the indicator is at least one of a mobile device, a smartphone device, a personal digital assistant (PDA) device, a remote data processing system, an input device of a data processing system, an output device of a data processing system, an infrared remote, a custom-designed remote configured for a particular protection device, a website synced with the designated user-account associated with the particular protection device and an RFID tag configured to the particular protection device.

* * * * *